United States Patent [19]

Smith et al.

[11] Patent Number: 4,685,516

[45] Date of Patent: Aug. 11, 1987

[54] APPARATUS FOR OPERATING WIRELINE TOOLS IN WELLBORES

[75] Inventors: Lonnie J. Smith, Allen, Tex.; Curtis G. Blount, Wasilla, Ak.; Steven G. Petermann, Plano, Tex.

[73] Assignee: Atlantic Richfield Company, Los Angeles, Calif.

[21] Appl. No.: 820,851

[22] Filed: Jan. 21, 1986

[51] Int. Cl.[4] ..... E21B 19/22

[52] U.S. Cl. ..... 166/65.1; 166/385; 439/451

[58] Field of Search ..... 166/384, 385, 77, 301, 166/386, 379, 380, 98, 65.1; 339/104, 45 R, 45 M

[56] References Cited

U.S. PATENT DOCUMENTS

| | | | |
|---|---|---|---|
| 2,661,063 | 12/1953 | Owens | 166/301 |
| 3,034,088 | 5/1962 | Caller | 339/45 R |
| 3,401,749 | 9/1968 | Daniel | 166/77 X |
| 3,503,444 | 3/1970 | Owen | 166/385 X |
| 3,594,701 | 7/1971 | Ramsey | 339/104 X |
| 3,781,456 | 12/1973 | Knowles et al. | 166/65.1 X |
| 4,498,532 | 2/1985 | Mason | 166/77 X |
| 4,570,709 | 2/1986 | Wittrisch | 166/65.1 X |
| 4,624,308 | 11/1986 | White | 166/65.1 |

*Primary Examiner*—Stephen J. Novosad
*Assistant Examiner*—David J. Bagnell
*Attorney, Agent, or Firm*—Michael E. Martin

[57] ABSTRACT

A downhole tool is supported by coilable tubing extending into the wellbore from a tubing injection and withdrawal apparatus and includes an elongated electrical signal transmitting cable extending through the tube between the tool and the injection apparatus. The tool is connected to one end of the tube by a connector assembly which provides for limited swiveling movement of the tool relative to the end of the tube to preclude excessive lateral loads from being exerted on the tool during positioning of the tool in the wellbore. The connector assembly includes a frangible coupling comprising coupling members which are interconnected by shearable pins whereby separation from the tool will occur at the connector assembly in the event the tool becomes stuck in the wellbore. One of the coupling members includes a fishing neck for engagement with a suitable fishing tool whereby the downhole tool may be retrieved if separated from the tubing. Fluids may be pumped downhole through the tube and the connector assembly to provide improved downhole operating methods.

21 Claims, 9 Drawing Figures

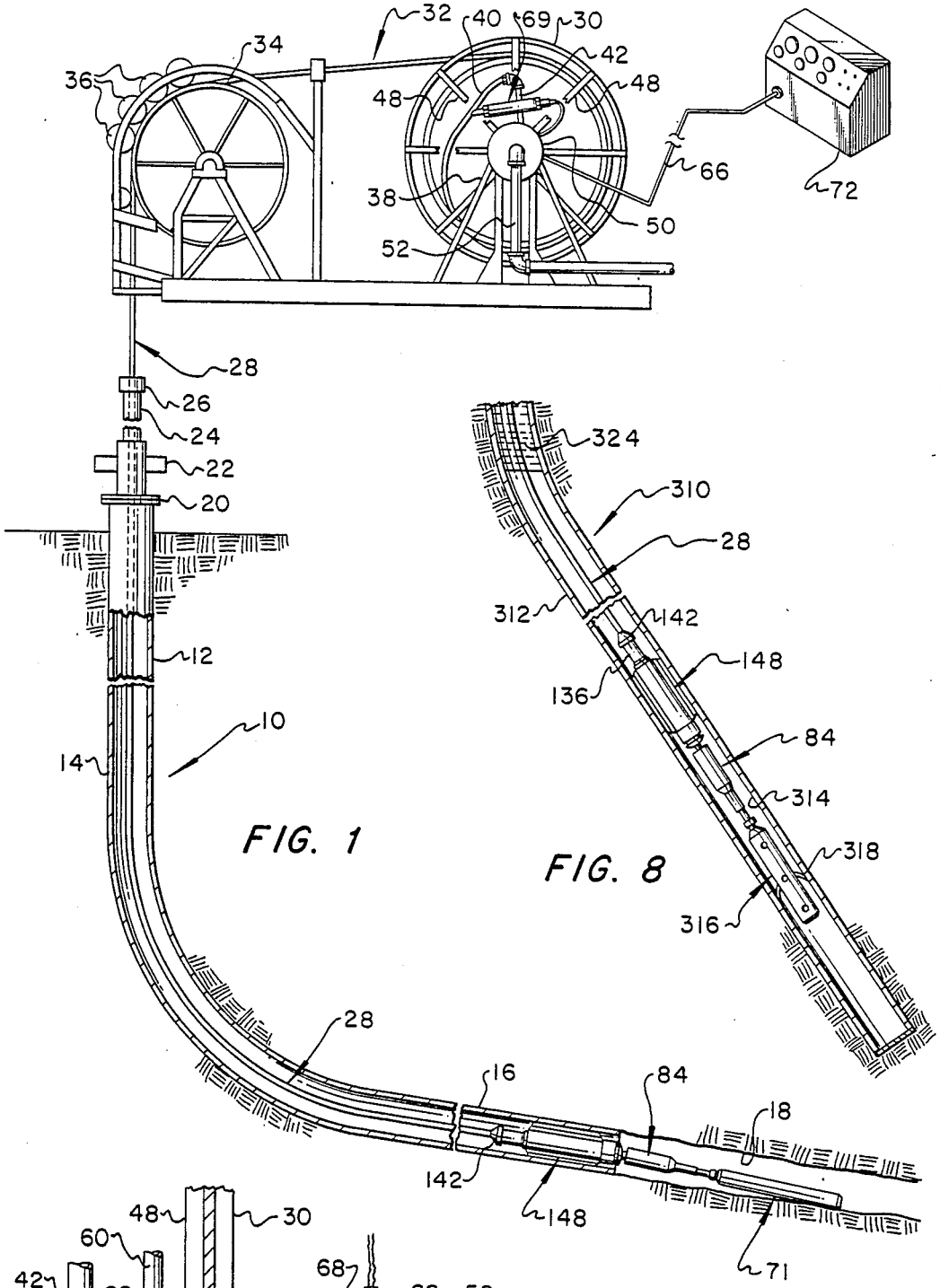
FIG. 1
FIG. 8
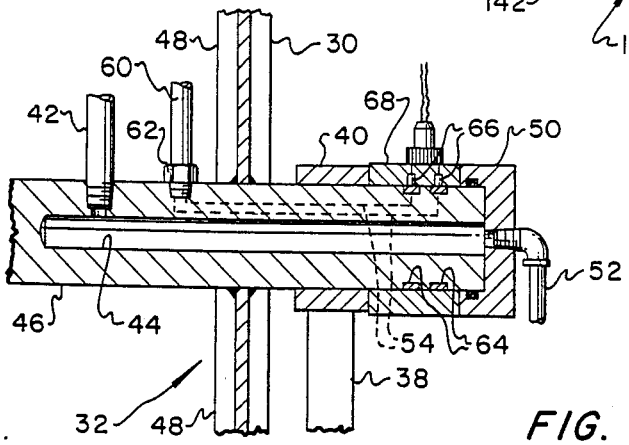
FIG. 2

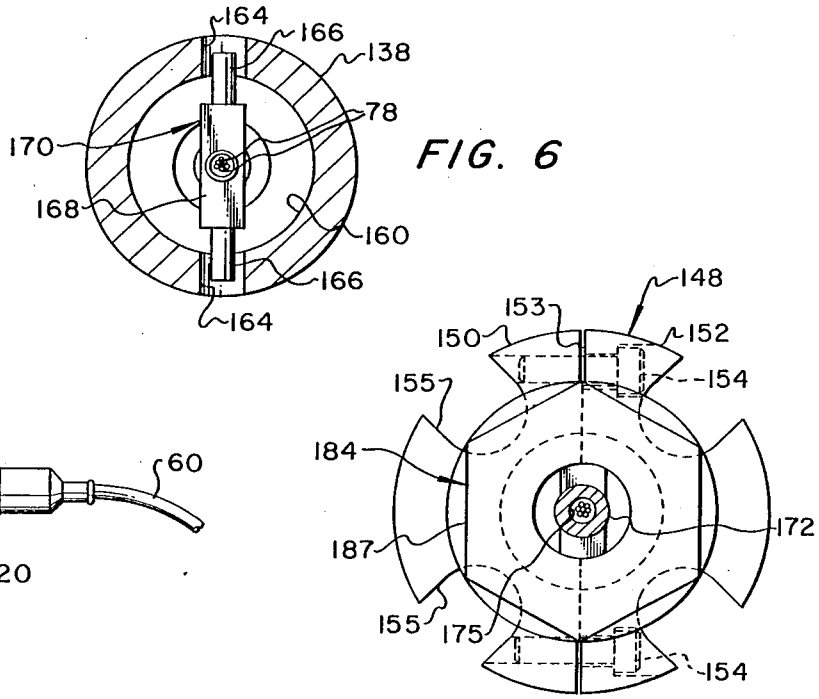
FIG. 6
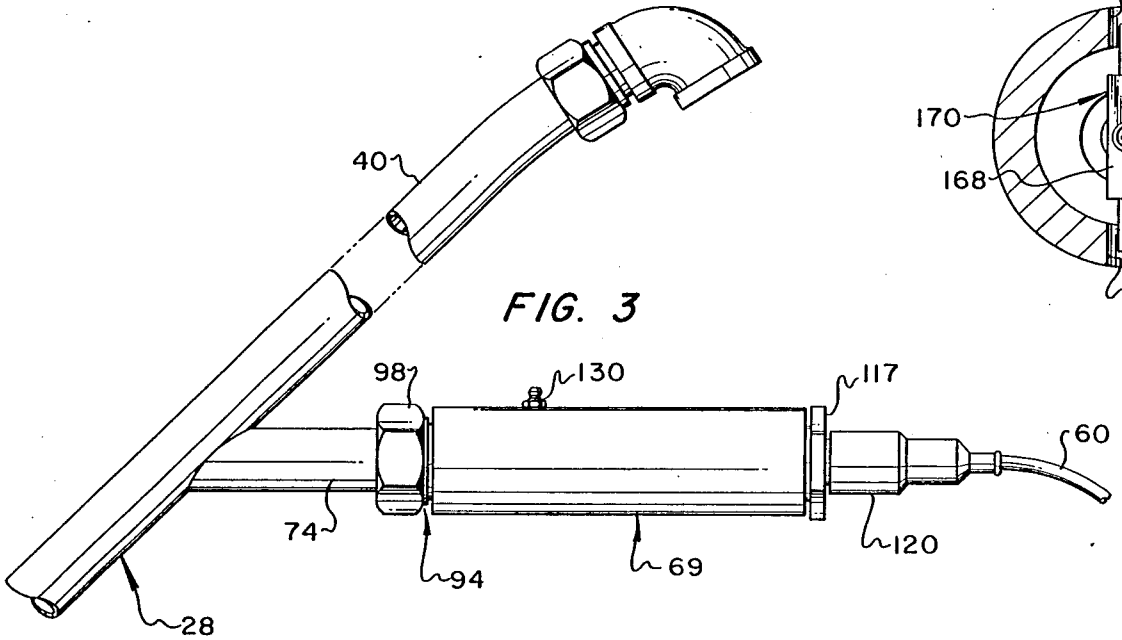
FIG. 3
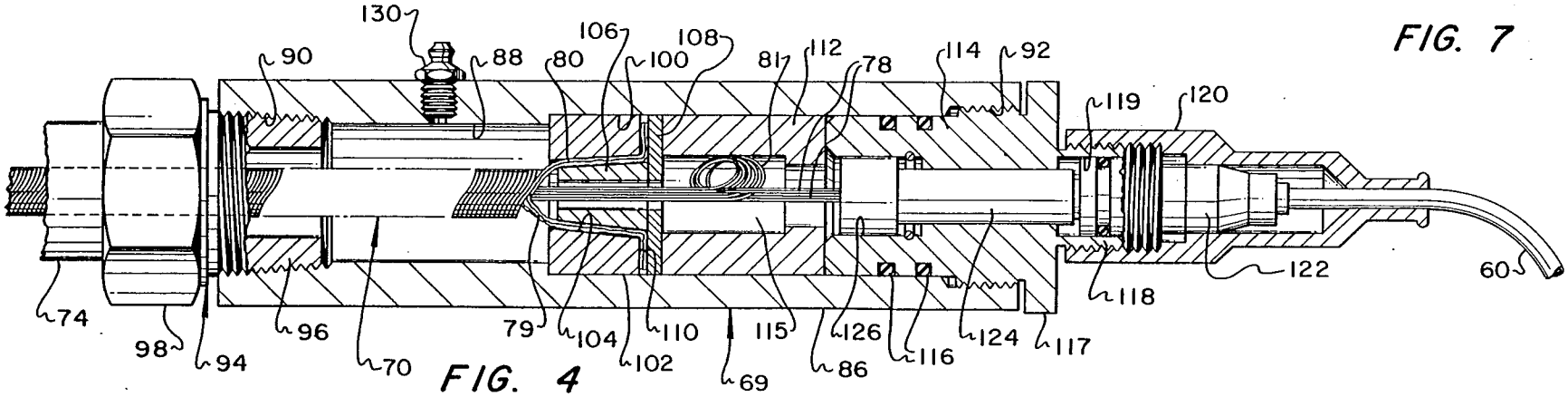
FIG. 7
FIG. 4

APPARATUS FOR OPERATING WIRELINE TOOLS IN WELLBORES

BACKGROUND OF THE INVENTION

1. Field of the Invention

The present invention pertains to a system for positioning certain downhole tools in wellbores using coiled metal tubing having an electrical cable or wireline disposed therein and including connector apparatus at each end of the tubing for supporting the downhole tool and providing a take off point for the electrical cable, respectively.

2. Background

In various downhole operations in wellbores for producing hydrocarbon fluids certain difficulties arise in positioning downhole tools, particularly in deviated wells. For example, various types of electrically operated downhole tools, such as logging sondes and perforating tools, are usually lowered into the wellbore at the end of a flexible armored cable or wireline. In deviated wells, in particular, the positioning of downhole tools at the end of a flexible cable such as a wireline, can become particularly difficult since gravity alone may not be sufficient to lower the tool into the desired position in the wellbore. Moreover, if the tool tends to become stuck or resists pull-out operations, the wireline cable will stretch much like a rubber band before the holding force is overcome such that the performance of logging operations, for example, may be highly inaccurate.

In this regard, it has been suggested to position downhole tools with a somewhat more rigid positioning member such as coilable metal tubing which is used in various other types of well operations. U.S. Pat. No. 3,401,749 to W. L. Daniel, for example, suggests positioning a logging tool in a deviated wellbore using coilable metal tubing within which the wireline cable is extended. However, certain problems associated with positioning downhole tools with coilable tubing have heretofore been unsolved. Among those problems is locating or centering a logging tool, for example, in the wellbore, which may be impossible if the tool is rigidly connected to the relatively inflexible tubing. Moreover, with prior art arrangements, moving logging and other types of downhole tools into and out of deviated wellbores using coilable tubing also results in urging the tool against the side of the wellbore with such force as to risk damage to the tool or the wellbore and to prevent desired positioning of the tool.

Other problems associated with positioning downhole tools in wellbores using coilable tubing include providing suitable means for separation of the wireline cable at a location which will permit retrieval or fishing operations to be carried out and to prevent the possible accumulation of several hundred feet of wireline piled on top of the logging tool in the event of cable failure at a point substantially uphole from the tool itself. There are several other problems and desiderata which have been solved and have been provided by the apparatus and method of the present invention as will be further appreciated by those skilled in the art.

SUMMARY OF THE INVENTION

The present invention provides an improved system for positioning downhole tools in subterranean wellbores using elongated, coilable metal tubing as the primary positioning structure and wherein an electrical cable or wireline is extended inside the tubing between the tool and suitable recording or control apparatus on the surface.

In accordance with one aspect of the invention, there is provided an improved connector between a downhole tool and the lower or distal end of a relatively stiff coilable metal tube which provides for limited freedom of movement of the tool relative to the tube to facilitate movement of the tool within the wellbore and to minimize damage to the tool during insertion and movement of the tool within the wellbore.

In particular, a connector assembly is provided which includes a coupling device providing for limited movement of the tool relative to the end of the tubing section to which the tool is connected. The connector assembly also includes an improved arrangement for securing a wireline cable to prevent stressing of the cable conductors or pullout of the cable from its connection to the downhole tool. The connector assembly still further provides a frangible coupling which will provide for separation of the tool from the tube at a predetermined tension or pull-out force exerted on the tube and at a location which will substantially preclude separation of the wire-line cable at a point which would result in accumulation of cable in the wellbore above the tool or above the point whereby suitable tool retrieval operations could not be carried out.

The present invention still further includes an improved connector sub and an improved centralizer arrangement whereby fluid may be injected into the wellbore through the coilable tube at a point in the wellbore close to the tool. The connector assembly is adapted to be used in conjunction with improved methods of operating downhole tools wherein fluids may be injected into the wellbore in the immediate vicinity of the tool to displace or condition certain well fluids and to facilitate the operation of certain wellbore imaging tools. Such operations, as drawdown, using nitrogen gas and providing cooling fluids to prevent degradation and damage to tools in high temperature wellbores are also made possible or more convenient to perform with the present invention.

The present invention further provides an improved system for positioning a downhole tool in a wellbore using coilable tubing in which an electrical cable is run and wherein the cable exits the tubing at a takeoff point within a tubing storage reel and through an improved connector assembly at the upper end of the tubing.

The present invention provides several advantages in positioning and operating downhole well tools, including logging tools and perforation apparatus. The system eliminates problems associated with positioning downhole tools with stranded flexible cable or wireline in both open and cased hole operations and provides for a more accurate positioning of devices, such as logging tools, with minimal changes of damaging the tools themselves. The system also presents sufficient rigidity of the tool support structure to prevent tools such as perforating guns from being blown up the wellbore during perforating operations. Other advantages of the system include providing for introduction of fluids into the wellbore prior to or during logging and perforating operations to provide more accurate and higher resolution logs or other inspection processes and to minimize the change of the downhole tool becoming stuck in the wellbore.

These advantages and other superior features of the invention will be further appreciated by those skilled in the art upon reading the detailed description which follows in conjunction with the drawing.

BRIEF DESCRIPTION OF THE DRAWING

FIG. 1 is a somewhat schematic view of a deviated wellbore, showing the downhole tool positioning system in accordance with the present invention;

FIG. 2 is a detailed section view of the coiled tubing storage reel of the tubing injector unit illustrated in FIG. 1 and showing one arrangement of providing electrical and fluid conductive paths to the coilable tube stored on the reel;

FIG. 3 is a detail elevation of the upper end connector assembly;

FIG. 4 is a longitudinal central section view of the connector assembly at the upper end of the coilable tubing section;

FIG. 6 is a section view taken substantially along the line 6—6 of FIG. 5A;

FIG. 7 is a section view taken substantially along the line 7—7 of FIG. 5A; and FIG. 8 is a detail section view of a tool disposed in a wellbore using the connector assembly and method of the present invention.

DETAILED DESCRIPTION OF PREFERRED EMBODIMENTS

Figure 5A:
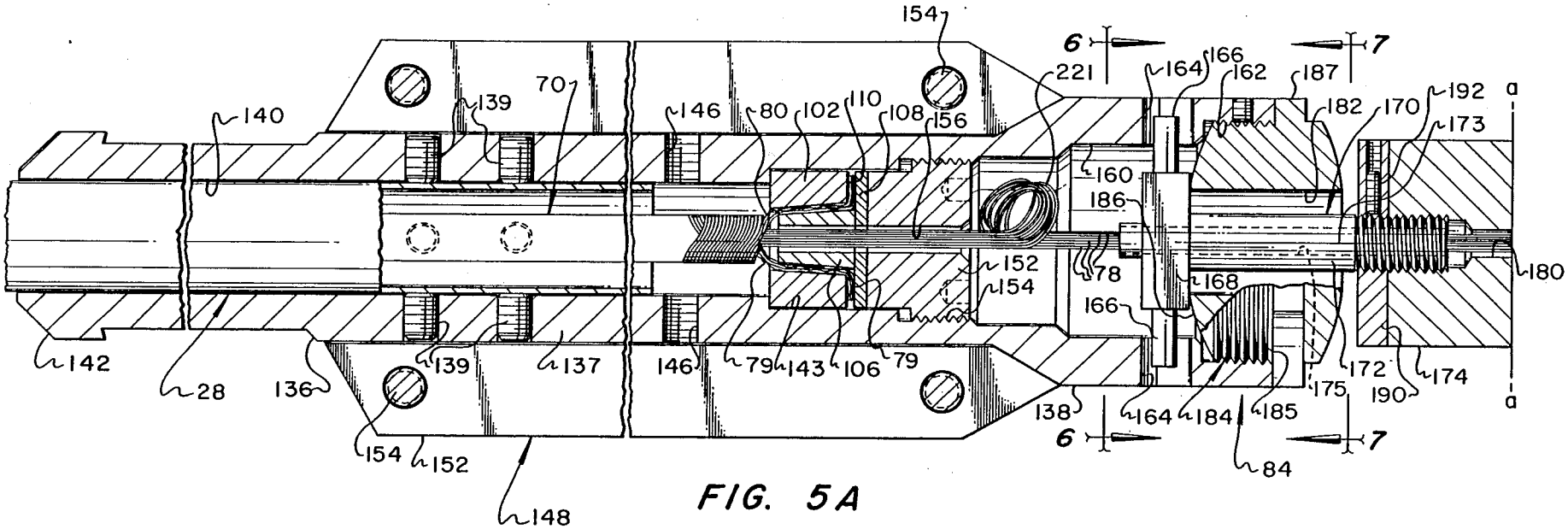
FIGS. 5A and 5B comprise a longitudinal central section view of the connector asssembly between the coilable tube and a downhole tool.

In the description which follows, like parts are marked throughout the specification and drawing with the same reference numerals, respectively. The drawing figures are not necessarily to scale and certain features of the invention may be shown exaggerated in scale or in somewhat schematic form in the interest of clarity and conciseness.

Referring to FIG. 1, there is illustrated in somewhat schematic form a system for locating a logging tool or other type of downhole tool in a wellbore using what is known in the art as coiled tubing. In FIG. 1 there is illustrated a deviated well, generally designated by the numeral 10. By way of example, the well 10 includes a generally vertically oriented section 12 provided with suitable well casing 14 and a deviated section 16, a portion of which may be uncased and indicated as a wellbore 18. Deviated wellbores may assume various orientations and in the search for and development of hydrocarbonbearing formations in more inaccessible locations, wellbores which transcend from substantially vertical to substantially horizontal orientation have been considered and drilled. The well illustrated in FIG. 1 includes a conventional wellhead 20, a blowout preventer 22, and a conventional lubricator assembly 24, including means for inserting and removing tools for traversal of the wellbore. The lubricator 24 includes a suitable stuffing box 26 through which an elongated coilable metal tube 28 has been inserted and extended into the wellbore as illustrated.

The tube 28 is of a type well known for use in carrying out various well opeations and typically comprises a relatively thin-walled steel tube which may be plastically deformed and stored on a suitable reel, generally designated by the numeral 30. The reel 30 is part of a coiled tubing injector unit 32, also having a rotatable spool 34 over which the tube 28 is trained and straightened by a series of propelling and straightening rollers 36. The tubing injector unit may take various forms and the unit 32 is illustrated basically by way of example only. The reel 30 may be rotated by suitable motor means, not shown, and mounted for rotation on a suitable support structure 38, including a bearing 40, see FIG. 2 also.

The reel 30 may be adapted to store several thousand feet of tube 28 in a manner not unlike the storage of flexible cable. The upper end of the tube 28 is indicated by the numeral 40 in FIGS. 1 and 3, and is connected to a suitable conduit 42 which, as illustrated in FIG. 2, is in communication with a passage 44 formed in the interior of a central support shaft 46 for the reel 30. The shaft 46 is connected to suitable radially extending spokes 48 and is itself supported in spaced apart bearings 40, one shown in FIG. 2. Fluid may be introduced into the passage 44, the conduit 42 and the interior of the tube 28 by way of a suitable swivel connector assembly which may, as shown by way of example, be formed by a distal end of the shaft 46 and a cap member 50 which is secured in a suitable manner to be stationary relative to the bearing 40. The cap 50 is connected to a suitable conduit 52 which is adapted to be in communication with a source of pressure fluid in either liquid or gaseous form, not shown in the drawing figures.

Referring further to FIG. 2, the shaft 46 is also adapted to include a slip-ring arrangement for a plurality of electrical conductors 54 which are suitably electrically connected to an electrical cable disposed within the tubing 28 and to be described in further detail herein. An intermediate cable is generally designated by the numeral 60 in FIG. 2 and is suitably connected to the shaft 46 by a connector 62. The conductors 54 are in communication with respective electrical conductor rings 64 by which electrical signals may be transferred to conductor means 66 supported on a stationary slip-ring housing 68. A further detailed description of the slip-ring assembly comprising the slip-rings 64 and the housing 68 is not believed to be necessary to enable one skilled in the art to practice the present invention. Various types of electrical slip-ring assemblies are commercially available which would be suited or adapted for use in connection with the system of the present invention.

Referring now to FIGS. 3 and 4, the cable 60 is connected to an upper end connector assembly 69 for an electrical cable or wireline 70 which extends through the tube 28 from the tubing injector unit 32 to the lower end of the wellbore 18 for transmission of suitable electrical signals to a tool such as an elongated well logging tool 71, FIG. 1, shown disposed in the wellbore 18. Those skilled in the art will recognize that various types of tools may be substituted for the logging tool 71 and which are adapted to receive and transmit signals between the wellbore 18 and a suitable surface apparatus, such as a control apparatus 72 shown in FIG. 1, and suitably connected to the conductors 66.

Referring further to FIGS. 3 and 4, the upper end portion 40 of the tube 28 includes a branch portion 74 which is coupled to the upper end connector 69 for the wireline cable 70. The cable 70 may take various forms but typically is a conventional wireline cable which may include a plurality of insulated electrical conductor wires 78, FIG. 4, which are contained within an outer shell or armor made up of plural layers of wound steel wire or other suitable filamentary materials. In the example shown, the cable 70 includes an inner layer of wound steel filaments or wires 79 and an outer layer of steel filaments or wires 80 which are wound in opposite directions around the core of the cable formed by the plural conductor wires 78. The layers of steel filaments 79 and 80 serve as a relatively flexible protective armor and tensile load bearing structure for the cable 70 and may or may not be covered with an outer layer of insulation or a suitable protective coating. The cable 70 extends entirely through the tube 28, including the branch portion 74, between the upper end connector assembly 69 and a lower connector assembly 84, FIG. 1.

Referring again to FIG. 4, the upper connector assembly 69 includes a generally cylindrical body member 86 having an elongated stepped bore 88 extending therethrough and being formed with suitable internal pipe threads 90 at one end and suitable internal machine threads 92 at the opposite end. The connector body 86 is connected to the tube branch portion 74 by a conventional tube fitting assembly 94 having a body member 96 threadedly engaged with the connector body 86 and a nut 98 threadedly connected thereto. An enlarged portion 100 of the bore 88 is adapted to receive a generally cylindrical cable anchor body 102 having a frustoconical bore 104 formed therein and which is adapted to receive a frustoconical plug 106 adapted to fit within the bore 104, as illustrated.

The plug 106 and the bore 104 are dimensioned such as to receive a plurality of the armor filaments 79 and 80 which are preferably unwound and inserted in the bore 104 to be clamped between the plug 106 and the body 102. The plug 106 is retained in the bore 104 by a clamp washer 108 which also clamps the distal ends of the filaments 79 and 80 against a transverse end face 110 of the body 102. The plug 106 and the washer 108 are secured in their cable clamping position by a hollow spacer 112 and a nut 114 which is threadedly engaged with the end of the connector body 86, as illustrated. The nut 114 includes suitable spaced apart o-ring seals 116 disposed on the periphery thereof and adapted to be in sealing engagement with the bore 100 to prevent fluid leakage from the end of the connector body 86. The nut 114 is also provided with a head 117 which is preferably of generally hexagonal configuration in cross section, not shown, to provide for application of conventional wrench to the nut for securing it to the connector body 86. The nut 114 also includes an axially extending head portion 118 which is preferably externally threaded and adapted to receive a connector member 120 for the cable 60. The connector 120 is adapted to house part of a commercially available plug and socket connector ssembly, including a plug portion 122 which can be fitted in a bore 119 formed in the head portion 118 and a socket member 124 which is preferably disposed in a stepped bore 126 formed in the nut 116. The socket member 124 is adapted to include a plurality of individual terminals, not shown, which are each connectable to one of the conductor wires 78, respectively, whereby signals transmitted by the wires 78 may be transferred to the cable 60. The spacer 112 defines a chamber 115 wherein a strain relief coil 81 may be formed in the conductor wires 78. The plug 106 and the washer 108 are suitably bored to provide a passage for the conductor wires 78.

The aforedescribed arrangement of the connector assembly 69 offers several advantages for terminating a wireline cable such as the cable 70 at the upper end of a section of elongated coilable tubing such as the tube 28. The cable anchor body 102, plug 106 and washer 108 provide means for securing the cable jacket or armor sheath comprising the filaments 79 and 80 at the upper end of the cable 70 to eliminate any longitudinal strain on the conductor wires 78. Moreover, the connector 120 and plug 122 provide for disconnecting the cable 60 from the connector assembly 69 and removal of the nut 114 to provide for access to the spacer 112 and the cable retaining plug and body parts. The connector 69 is essentially a fluid-tight structure when assembled and may be injected with a suitable grease or the like into the bore 88 through a conventional fitting 130 to form a barrier between fluids which are being pumped through the tube 28 and the connector assembly itself.

Referring now to FIGS. 5 through 7, the lower connector assembly 84 includes an elongated, generally cylindrical sub member 136, FIG. 5A, having an enlarged diameter head portion 138 and an elongated bore 140 which extends from a fishing neck 142 to a first enlarged bore portion 143. A shank portion 137 of the sub is provided with several rows of threaded fastener receiving holes for receiving tube retaining fasteners 139 so that the distal end of the tube 28 may be suitably secured to the sub 136. A set of fluid injection holes 146 are provided in a circumferentially spaced pattern and open into the bore 140 to provide communication of pressure fluid between the tube 28 and the wellbore 18. One or more of the holes 146 may be plugged by insertion of a suitable threaded member such as a headless socket head screw or the like, not shown.

Referring to FIGS. 5A and 7, the shank portion 137 of the sub 136 is adapted to be relatively loosely journaled by a centralizer member 148 having opposed longitudinally separable centralizer sections 150 and 152 which are secured together at a parting line 153 by spaced apart fasteners 154, suitably threaded into tapped holes in the section 150. The centralizer 148 is provided with conventional fluid conducting passages 155 and is of a diameter suitable to aid in locating the tube 28 generally coaxial in the bore of the casing 12. Although the sub 136 is adapted for use with the centralizer 148, those skilled in the art will recognize that the use of the centralizer is not mandatory and the improved lower connector assembly 84 is particularly adapted for connecting the tool 71 to the tube 28 with or without the use of the centralizer.

Referring further to FIG. 5A, the end of the cable 70 opposite the end attached to the connector 82 is anchored in the sub 136 by unraveling ends of the the armor filaments 79 and 80 and removing some of the unraveled filament ends surrounding the conductor wires 78. The unraveled armor filaments 79 and 80, not removed or cut off, are secured between a second cable anchor body 102, plug 106 and washer 108 disposed within the bore 142, as illustrated, and secured therein by a lock nut 152 which is threadedly engaged with cooperating internal threads 154 forming a further enlarged portion of the bore 140. The lock nut 152 includes a longitudinal bore 156 formed therein and providing a passage for the insulated conductor wires 78.

Figure 5B:
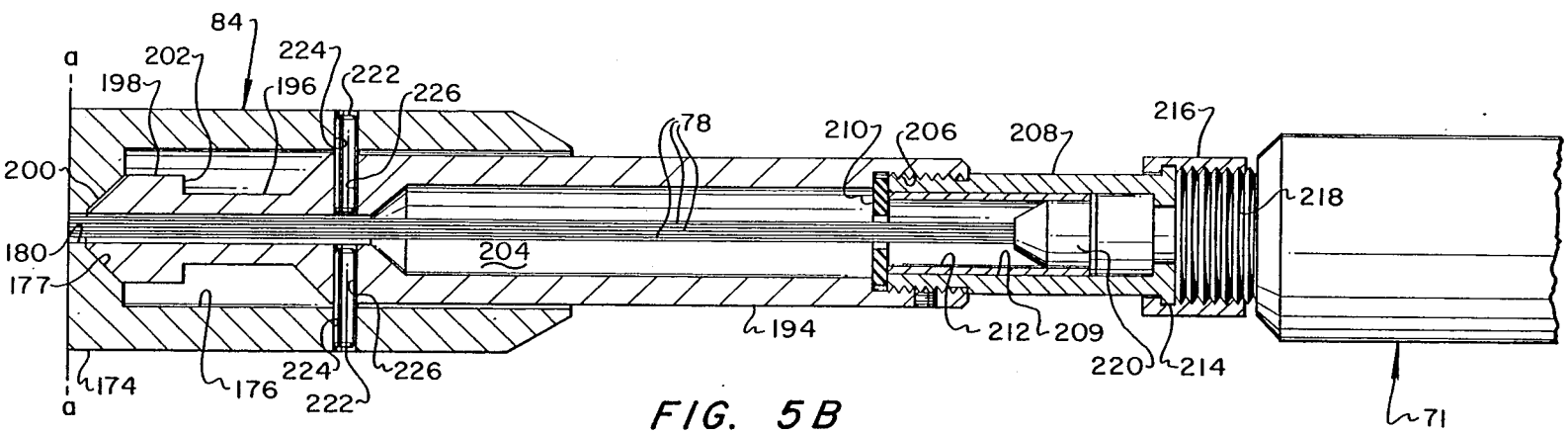

The enlarged head portion 138 of the sub 136 includes a further enlarged bore portion 160 which is counterbored and internally threaded at 162. The bore portion 160 is intersected by opposed radially extending elongated slots 164, see FIG. 6 also, which are adapted to receive opposed trunnions 166 extending into the slots 164 and projecting from the head 168 of a coupling member 170. The coupling member 170 includes a shank 172 which is threaded on its distal end and is adapted to be threadedly engaged with an elongated cylindrical coupling body 174. The coupling body 174 is also illustrated in FIG. 5B which is an extension of FIG. 5A from the parting line a-a in both drawing figures. The coupling body 174 includes an elongated bore 176 formed therein which extends to a transverse wall 177 in which a frustoconical recess 178 is formed and opens into a central passage 180 for receiving the conductor wires 78.

Referring back to FIG. 5A, the coupling member 170 extends through relatively large bore 182 formed in a head 184. The head 184 includes an externally threaded portion 185 for engagement with the threads 162 to secure the head to the sub 136, as illustrated. A generally spherical bearing surface 186 is formed on the head 184 and is engageable with the hub 168 of the coupling member 170 for retaining the coupling member connected to the sub 136. The diameter of the bore 160, the axial width of the slots 164 and the span of the trunnions 166 of the coupling member 170 is such that the coupling member may be inserted into the bore 160 and the trunnions 166 extended into the slots 164 and retained therein by threading the head 184 into engagement with the sub head portion 138. However, when assembled as illustrated in FIG. 5A, the coupling member 170 cannot be displaced sufficiently laterally to allow the trunnions 166 to move out of the slots 164. An axial passage 175 extends through the coupling member 170 to provide a wireway for the conductor wires 78.

The coupling member 170 may rotate only a limited degree about its longitudinal axis 173 so that rotational orientation of the tube 28 will assure a related rotational position of the tool 71 within the angular excursion limits of the coupling member 170 provided by the slots 164 and the trunnions 166. The head member 184 includes a flange 187 having a hexagonal cross sectional shape to permit engagement by a suitable wrench for tightening the head in engagement with the sub 136. The coupling member 170 is also locked in engagement with the coupling body 174 by a generally cylindrical locknut 190 having one or more radially disposed set screws 192 threadably engaged therewith and adapted to secure the locknut 190 nonrotatably relative to the shank of the coupling member 170. The coupling body 174 may be formed to have a fishing neck on the end of the coupling body into which the member 170 is threaded in the unlikely event that the member 170 should fail.

The lower connector assembly 84 further includes a frangible coupling section including the body 174 and an elongated, generally cylindrical coupling member 194, FIG. 5B. The coupling member 194 includes a reduced diameter portion 196 having a fishing neck 198 formed thereon and including a generally frustoconical nose surface 200 and an opposed, generally transverse shoulder 202. The coupling member 194 includes means forming an elongated longitudinal passage 204 extending therethrough for receiving the conductor wires 78. The end of the coupling member 194 opposite the fishing neck 198 is provided with internal threads 206 for receiving a nipple 208 in threaded engagement therewith. A suitable washer 210 is disposed in the bore formed by the threads 206 and forms a closure for a bore 209 in the nipple 208 and for retaining a connector retaining sleeve 212 within the bore 209. The nipple 208 includes a transverse retaining collar 214 for a nut 216. The nut 216 is adapted to engage a cooperating projection 218 formed on the tool 71 for connecting the tool to the connector assembly 84. The conductor wires 78 extend into a suitable plug member 220 which is retained in the bore 209 by the sleeve 212. The plug member 220 includes suitabe terminals, not shown, for electrical connection of the conductor wires 78 to further conductor means within the tool 72. A detailed description of the plug member 220 is not believed to be necessary to an understanding and practice of the present invention. Suffice it to say that the conductor wires 78 may separate from the plug member upon being subjected to a generally axial pulling force greater than the strength of the connection between the wires 78 and the plug member 220. Alternatively, the plug member 220 could be adapted to separate from a cooperating socket portion, not shown, upon separation of the coupling member 174 from the coupling member 194 in a manner to be described further hereinbelow. As shown in FIG. 5A, the conductor wires 78 are preferably of sufficient length to provide a strain relief loop 221 within the bore 160.

Referring further to FIG. 5B, a frangible coupling is formed between the coupling members 174 and 194 by opposed shear pins 222 which extend in relatively tight fitting relationship within cooperating bores 224 and 226 formed in the members 174 and 194, respectively. The pins 222 may be of predetermined diameter and material shear strength such that, in response to a predetermined axial pulling force tending to separate the member 174 from the member 194, the pins 222 will fail in shear to permit separation of these two members. The force at which the pins 222 will shear off across an interface between the exterior cylindrical surface of the member 194 and the bore 176 is predetermined to be less than the force which will provide axial separation or rupture of the tube 28 or the cable 70. Accordingly, in the event that the tool 71 becomes stuck in the wellbore 18 during an attempt to move the tool "up hole", the connector 84 will separate at the connection point between the members 174 and 194 and the conductor wires 78 will fail in tension or pull out of the plug 220 to leave the connector member 194 in assembly with the tool 70 in the wellbore 18. In this event, the fishing neck 198 is exposed for engagement with a suitable fishing tool for eventual retrieval of the tool 71 together with the connector member 194 and the nipple 208 in assembly therewith.

As will be appreciated from the foregoing description, the coupling formed by the coupling member 170 and the head 184 provides for limited angular and rotational excursion of the tool 71 relative to the sub 136 whereby the tool may be allowed to generally center itself axially in the wellbore 18 while being pushed or pulled threrethrough. More particularly, the arrangement of the present invention permits the tool 71 to avoid being forcibly displaced against the sidewall of the wellbore as the tube 28 is moved throughthe wellbore. In this way, any irregular portions of the wellbore sidewall surface will not be as likely to snag or impede the movement of the tool 71 as it is extended or retracted longitudinally through the wellbore. By extending the tool 71 into the wellbore 18 using the relatively stiff coilable tube 28, the tool may be moved within the wellbore without undergoing the "rubber band" effect of the tool extension member which is often encountered with tools which are merely suspended in the wellbore by the wireline cable itself. Moreover, it is not necessary to rely on gravity or other techniques to force the tool 71 deeper into the wellbore since axial extension of the tube 28 may be carried out through operation of the coiled tubing unit 32 to forcibly move the tube in either direction through the wellbore.

Thanks further to the connector assembly 84, there is no substantial axial stress on the wireline cable 70 during operations of the tool 71. Those skilled in the art will further appreciate that various types of tools may be utilized in connection with the connector assembly 84 and traversed in and out of a wellbore using the coilable tube 28 and an electrical signal conductor extending through the tube. In certain types of perforating operations the fluid pressures encountered sometimes tend to propel the perforating tool axially through the wellbore after or during the perforating process. This problem is, of course, avoided with the use of the coiled tube 28 and the connector assembly 84 of the present invention as means for inserting, positioning and withdrawing a perforating tool with respect to a wellbore.

A substantial length of coiled tube 28 may be modified to receive a single or multi-conductor armored cable such as the cable 70, preferably by uncoiling the length of tube in question and inserting the cable axially through the uncoiled length of tube using a pilot wire which has been propelled through the tube by a small piston or pig device, not shown, attached thereto and pumped through the tube with pressure fluid to draw the pilot wire through. The pilot wire may then be attached to one end of the cable 70 whereby the cable is pulled through the tube 28 until it is extending from both ends whereby it may be prepared for anchoring to the connector assemblies 69 and 84. In preparing the cable 70 for connection of the conductor wires 78 to the connector 220, for example, sufficient lengths of the armor filaments 79 and 80 are removed to permit extension of the conductor wires 78 from the plug 106 to the plug assembly 220 through the passages formed in the nut 152, the coupling members 170, 174 and 194 and the nipple 208 and with sufficient slack to form the strain relief loop 221 and to permit angular excursion of the coupling member 170 and the connector body 174 relatively to the sub 136. If a centralizing device is used in connection with the tool 71, the flexible coupling formed by the members 170 and 184 will permit substantial alignment of the tool, generally co-axial in the wellbore.

The connector assembly 84 may be made up after insertion of the lower end of the tube 28 through the stuffing box 26 by attachment of the sub 136 to the tubing, extension of the cable 70 through the sub, preparation of the cable for anchoring within the sub, as well as extension of the conductor wires 78 through the respective connector parts described in conjunction with drawing FIG. 4. The pins 222 would be selected in accordance with the desired maximum axial force to be exerted on the connector assembly before shearout of the pins to prevent failure of the tube 28 and the cable 70 at some point uphole from the connector assembly 84. The tool 71 would then be connected to the lower end of the connector assembly 84 and inserted into the wellbore through the lubricator 24. The centralizer 148 could also be connected to and journaling the sub 136 by bolting the centralizer halves 150 and 152 together in surrounding relationship to the shank portion 137, all of this work being carried out through the lubricator 24 in a conventional manner known to those skilled in the art for installing or inserting downhole tools through a conventional wellhead. The tube 28 can then be extended into the wellbore 18 for positioning of the tool 71, as desired.

If fluids are to be injected through the conduit 52 and the tube 28, suitable fluid flow into the wellbore 18 may be obtained through the passages 146 during various operations which can be carried out depending on the type of apparatus or tool connected to the lower end of the connector assembly 84. Referring to FIG. 8, for example, there is illustrated a deviated well, generally designated by the numeral 310, which is formed by a well casing 312 to provide a wellbore 314. In the arrangement illustrated in FIG. 8, the casing 312 is ready to be perforated by a perforating tool, generally designated by the numeral 316. The perforating tool 316 is connected to the connector assembly 84 at the distal end of tube 28 in essentially the same manner that the tool 71 is connected to the connector assembly as illustrated in FIG. 5b. The tool 316 is typically provided with suitable centralizing arms 318 for centering the tool within the wellbore 314.

In many wellbores, at the time perforating operations are to be carried out, fluids are already present in the well from one source or another. It is desirable during some perforating operations to displace liquids which may include debris and other contaminants up the wellbore a distance clear of the perforating gun or tool and to effectively lower the bottom hole pressure just prior to firing the perforating tool. In the arrangement illustrated in FIG. 8, the tube 28 has been inserted into the wellbore by the injection unit 32 and gas has been pumped into the wellbore 314 to displace liquid 324 up the wellbore to a point substantially above the tool 316 so as to prevent adverse effects of the liquid 324 during perforating operations. Thanks to the arrangement of the connector assembly 84, fluid may be pumped down through the tube 28 and into the wellbore 314 in the vicinity of the tool 316 by way of the passages 146 and the nominal space provided by clearance between the shank 137 and the opposed sections of the centralizer assembly 148.

Other methods and applications which can benefit from use of the connector assembly 84 include wellbore inspection processes utilizing wellbore imaging or televiewing equipment connected to the connector assembly 84 in place of the tools 71 or 316, for example, and wherein a relatively clean homogeneous liquid is preferably injected into the wellbore to provide a suitable transmission path for signals which generate images of the wellbore surface using such imaging apparatus.

Those skilled in the art will recognize from the foregoing description that improved apparatus and methods for positioning wireline or similar electrical cablecontrolled tools in a wellbore have been provided by the present invention. Various substitutions and modifications may be made to the specific embodiments described herein without departing from the scope and spirit of the invention as recited in the appended claims.

What we claim is:

1. In a system for positioning a tool in a wellbore and for moving said tool longitudinally in said wellbore to a predetermined position;

an elongated, coilable tube adapted to be inserted in said wellbore, said tube being engageable with means for traversing said tube into and out of said wellbore;

electrical cable means extending through said tube from substantially one end thereof to the opposite end of said tube;

connector means at said one end of said tube for connecting said cable means to electrical conductor means; and a connector assembly disposed at said opposite end of said tube which is insertable in said wellbore for connecting a downhole tool to said tube, said connector assembly including means forming a coupling including a sub connected to said opposite end of said tube and means engageable with said sub to permit angular displacement and limited lateral excursion of said tool with respect to said tube to minimize lateral pressure on said tool in said wellbore while precluding substantial rotation of said tool relative to said tube.

2. The invention set forth in claim 1 wherein:

said connector assembly includes frangible coupling means between said tool and said tube for separating said tube from said tool at said connector assembly in response to a predetermined axial pulling force on said tube.

3. The invention set forth in claim 2 wherein:

said frangible coupling means includes a first coupling member and a second coupling member interconnected by shearable pin means.

4. The invention set forth in claim 3 wherein:

said second coupling member includes means for engagement with a fishing device for retrieval of said second coupling member and said tool after separation of said second coupling member from said first coupling member.

5. The invention set forth in claim 2 wherein:

said connector assembly includes anchor means for anchoring a load bearing portion of said cable to said connector assembly whereby electrical conductor means of said cable extend through said connector assembly in substantial relief of any axially directed forces thereon.

6. The invention set forth in claim 5 wherein:

said anchor means includes a body member having a conical bore, a conical plug insertable in said conical bore for forcibly engaging a plurality of filaments comprising said load bearing portion of said cable, and means for retaining said plug in said bore.

7. The invention set forth in claim 1 wherein:

said connector assembly includes a first coupling member supported on said sub and a second coupling member for retaining said first coupling member connected to said sub, said first coupling member including said means engageable with said sub.

8. The invention set forth in claim 7 wherein:

said second coupling member includes a bearing surface engageable with said first coupling member to provide for generally swiveling movement of said first coupling member relative to said second coupling member.

9. The invention set forth in claim 7 wherein:

said first coupling member includes a pair of opposed trunnions and said sub includes opposed slot means for receiving said trunnions in relatively loose fitting relationship whereby said first coupling member is adapted to move relative to said sub in a generally swiveling movement.

10. The invention set forth in claim 1 wherein:

said connector means includes anchor means for anchoring a load bearing portion of said cable to said connector means to relieve axially extending forces on said conductor means.

11. The invention set forth in claim 10 wherein:

said anchor means includes a body member having a conical bore, a conical plug insertable in said conical bore for forcibly engaging a pluarality of filaments comprising said load bearing portion of said cable, and means for retaining said plug in said bore.

12. The invention set forth in claim 1 wherein:

said connector assembly includes passage means formed therein for conducting fluid between said tube and said wellbore.

13. A connector for use in a system for positioning a tool in a wellbore and for moving said tool longitudinally in said wellbore to a predetermined position using an elongated, coilable tube adapted to be inserted in said wellbore, said tube being connected to means for traversing said tube into and out of said wellbore, and said tube including electrical cable means extending through said tube from substantially one end thereof to the opposite end of said tube;

said connector being adapted to be connected to said opposite end of said tube which is insertable in said wellbore for connecting a downhole tool to said tube, said connector including means forming a coupling including a sub connected to said opposite end of said tube and means engageable with said sub to permit angular displacement and limited lateral excursion of said tool with respect to said tube to minimize lateral pressure on said tool in said wellbore while precluding substantial rotation of said tool relative to said tube.

14. The connector set forth in claim 13 including:

means forming a frangible coupling between said tool and said tube for separating said tube from said tool at said connector in response to a predetermined axial pulling force on said tube.

15. The connector set forth in claim 14 including:

means forming a wire way for extending electrical conductor means of said cable assembly through said connector to said tool.

16. The connector set forth in claim 14 wherein:

said frangible coupling means includes a first coupling member and a second coupling member interconnected by shearable pin means, said second coupling member including means for engagement with means for retrieving said second coupling member and said tool from said wellbore after separation of said second coupling member from said first coupling member.

17. The connector set forth in claim 15 including:

means for anchoring a load bearing portion of said cable to said connector whereby electrical conductor means of said cable extend through said connector in substantial relief of any axially directed forces thereon, said conductor means being connected to electrical terminal supporting means on said connector.

18. The connector set forth in claim 13 wherein:

said connector includes a first coupling member supported on said sub and a second coupling member for retaining said first coupling member connected to said sub, said first coupling member including said means engageable with said sub.

19. The connector set fother in claim 18 wherein:

said second coupling member includes a bearing surface engageable with said first coupling member to provide for generally swiveling movement of said first coupling member relative to said second coupling member.

20. The connector set forth in claim 18 wherein:

said first coupling member includes a pair of opposed trunnions and said sub includes slot means for receiving said trunnions in relatively loose fitting relationship whereby said first coupling member is adapted to move relative to said sub in a generally swiveling movement.

21. The connector assembly set forth in claim 20 wherein:

said first coupling member includes passage means formed therein forming a wireway for extending said conductor means between said tool and said tube.

* * * * *